United States Patent [19]

Woodford et al.

[11] Patent Number: 5,033,913

[45] Date of Patent: Jul. 23, 1991

[54] MINE ROOF SUPPORT

[75] Inventors: Brian J. Woodford, Pershore; Peter Crossland, Cheltenham; James B. Longford, Tibberton, all of England

[73] Assignee: Meco Mining Equipment Limited, Tewkesbury, England

[21] Appl. No.: 604,463

[22] Filed: Oct. 29, 1990

[30] Foreign Application Priority Data

Dec. 23, 1989 [GB] United Kingdom ..... 8929160

[51] Int. Cl.[5] ..... E21D 23/04

[52] U.S. Cl. ..... 406/296; 405/295

[58] Field of Search ..... 405/291–296, 405/298; 299/32

[56] References Cited

U.S. PATENT DOCUMENTS 3,921,409 11/1975 Blumenthal ..... 405/296

FOREIGN PATENT DOCUMENTS 0641118 1/1979 U.S.S.R. ..... 405/295

0934035 6/1982 U.S.S.R. ..... 405/296

2088458 6/1982 United Kingdom .

2096680 10/1982 United Kingdom .

*Primary Examiner*—Dennis L. Taylor

*Attorney, Agent, or Firm*—Young & Thompson

[57] ABSTRACT

A mine roof support comprises a ground engageable base section, a canopy, a shield section pivotally connected at one end to one end of the canopy and at the other end to one or more members connected to the base section, and hydraulic props for raising and lowering the canopy relative to the base section. An opening is provided in the canopy and a door is mounted with respect to the canopy for pivotable movement between a first position in which it closes or substantially closes the opening in the canopy and a second position in which it is inclined downwards away from said one end and towards the other end of the canopy for guiding material which in use falls through the opening towards a conveyor located adjacent to a mine face being worked.

5 Claims, 1 Drawing Sheet

MINE ROOF SUPPORT

BACKGROUND TO THE INVENTION

This invention relates to a mine roof support and more particularly to a mine roof support suitable for use in a special way of mining coal, referred to as sub-level caving.

Mine roof supports include a ground engaging base section, a roof engageable canopy and hydraulic prop means for raising and lowering the canopy relative to the base section. Known roof supports for inter alia sub-level caving also include a shield section which is pivotally connected at one end to one end of the canopy and which is pivotally connected at its other end to one or more members, typically links of a lemniscate linkage arrangement, connected to the ground engaging base section. The shield section of known roof supports for sub-level caving is also provided with an opening which is normally closed by a door, but which, when the door is opened at an appropriate moment, is large enough to permit material which has fallen onto the shield section from above (e.g. by caving of a roof or, if necessary, by shot-firing) to pass through the opening into the space below that opening. In early designs of roof support for sub-level caving, the door was slidable relative to the shield section and material falling through the opening in the shield section was customarily removed by a conveyor supported on the ground engageable base section.

The conveyor for removing material falling through the opening was additional to the mine face conveyor and, in an attempt to do away with the need for this additional conveyor, later designs of roof support for sub-level caving utilised a pivotable door which when open served as a chute to guide the material from above the shield section onto the mine face conveyor.

However, it has been found that these roof supports suffer from the drawback that the angle of inclination of the chute is sometimes too small and the material does not pass along the chute.

SUMMARY OF THE INVENTION

In seeking to mitigate this drawback, the present invention provides a mine roof support comprising a ground engageable base section, a canopy, a shield section pivotally connected at one end to one end of the canopy and at the other end to one or more members connected to the base section, and hydraulic prop means for raising and lowering the canopy relative to the base section, wherein an opening is provided in the canopy and a door is mounted with respect to the canopy for pivotable movement between a first position in which it closes or substantially closes the opening in the canopy and a second position in which it is inclined downwards away from said one end and towards the other end of the canopy for guiding material which in use falls through the opening towards a conveyor located adjacent to a mine face being worked.

Because the opening is in the canopy rather than in the shield section, the angle of inclination of the door, when in its second position, can be larger than was hitherto possible so ensuring that material falling through the opening passes to the conveyor.

Preferably, the door is in the form of a chute.

Preferably, the canopy is a rigid single part canopy having a stepped upper surface defining a first portion at and adjacent to said one end of the canopy and a second portion, which is elevated with respect to the first portion, at and adjacent to the said other end of the canopy, the opening being provided in the first portion of the canopy.

Conveniently, the hydraulic prop means comprises first hydraulic prop means between the base section and the canopy and second hydraulic prop means between the base section and the door, the second hydraulic prop means serving to open and close the door and also to assist in supporting the canopy when the door is closed. In this case, hydraulic ram means is preferably provided between the shield section and the canopy to stabilise the canopy and shield section when the door is open.

The invention will now be more particularly described, by way of example, with reference to the accompanying drawings.

DESCRIPTION OF THE PREFERRED EMBODIMENT

Figure 1:
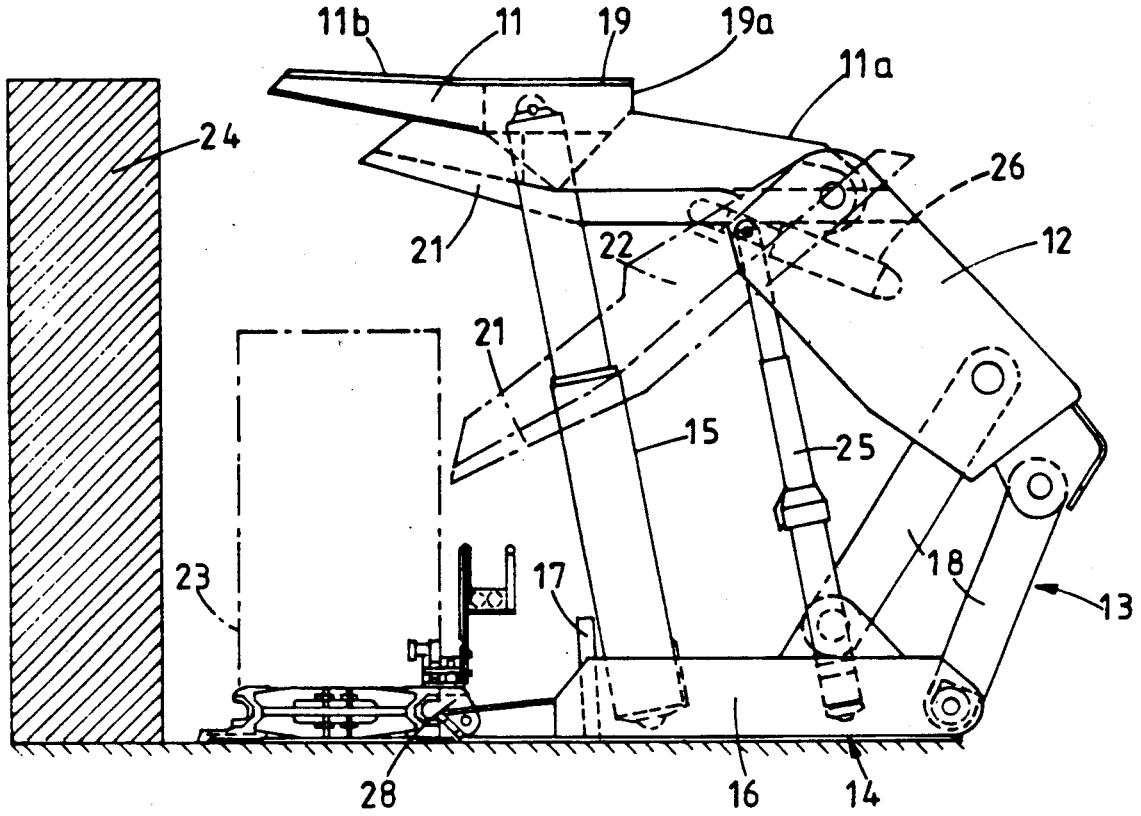
FIG. 1 is a side elevational view of one embodiment of a mine roof support according to the present invention.
Figure 2:
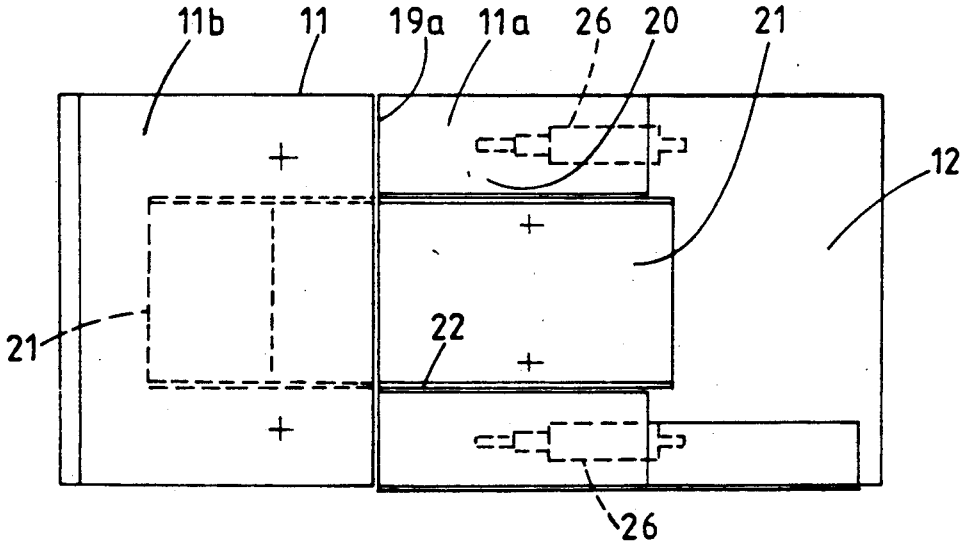
FIG. 2 is a plan view of the roof support shown in FIG. 1.

Referring to the drawings, the mine roof support shown therein comprises a canopy 11, a shield section 12, a lemniscate linkage arrangement 13, a base section 14 and two hydraulic props 15 for raising the canopy relative to the base section 14.

The base section 14 comprises two parallel spaced apart pontoon members 16 connected together by a bridge piece 17 adjacent to the leading end of the base section, i.e. that end of the base section which, in use, is nearer to the mine face.

The shield section 12 is pivotally connected at one end to one end of the canopy 11 and the lemniscate linkage arrangement 13, which includes four links 18, is pivotally connected at one end to the other end of the shield section 12, and at the other end to the pontoon members 16.

The canopy 11 is a rigid single part canopy having a stepped upper surface 19 defining a first canopy portion **11*a* at and adjacent to the one end i.e. the trailing end, of the canopy 11 and a second canopy portion 11*b*, which is elevated with respect to the first portion 11*a*, at and adjacent to the other end, i.e. the leading end, of the canopy 11. The step in the upper surface is shown at 19*a*** and is approximately midway between the leading and trailing ends of the canopy.

An opening 20 is provided in the first canopy portion **11*a* and in the example shown this opening extends over the entire length of the portion 11*a* and over approximately half the overall width of the portion 11*a***.

The opening 20 is normally closed or substantially closed by a door 21 which is mounted with respect to the canopy 11 for pivotal movement about an axis coincident with the pivot axis between the canopy 11 and the shield section 12.

The door 21 is pivotal between a first position (shown in full lines in FIG. 1) in which it closes or substantially closes the opening 20 and a second position (shown in broken lines in FIG. 1) in which it is inclined downwards towards the leading end of the roof support.

The door 21 is in the form of a chute having upstanding cheeks 22 along opposite side edges of its upper face to guide material from above the first canopy portion 11*a* towards a conveyor 23 located adjacent to the mine face 24.

The roof support also includes two hydraulic props 25 between the base section 14 and the door/chute 21, and two stabilising rams 26 between the canopy 11 and the shield section 12. The hydraulic props 25 serve to open and close the door 21, and also these props 25 assist in supporting the canopy 11 with respect to the base section 14 when the door 21 is closed. The rams 26 are used to stabilise the canopy 11 relative to the shield section 12 particularly when the canopy 11 is not set against a mine roof.

The roof support also includes an advancing mechanism which is disposed in the space between the pontoon members 16, and which comprises a relay bar (not shown), a mounting hook (also not shown) connected to one end of the relay bar, and an advancing ram (not shown) pivotally connected at one end to the other end of the relay bar and pivotally connected at its other end to the bridge piece 17. When the roof support is in use, the relay bar is anchored by connecting the mounting hook to the conveyor 23 as shown at 28 in Figure 1. The advancing mechanism can be operated in conventional manner to advance the roof support towards the mine face 24.

The mine roof support described above is used for mining coal in a way commonly referred as sub-level caving where the coal seam is relatively thick, typically 10 metres or more, the opening 20 being of appropriate dimensions to permit coal which falls onto the first canopy portion (e.g. by caving of the mine roof or by shot-firing) to pass through the opening and along the door/chute 21 to the conveyor 23.

The above embodiment is given by way of example only and various modifications will be apparent to persons skilled in the art without departing from the scope of the invention.

What we claim is:

1. A mine roof support comprising a ground engageable base section, a canopy, a shield section pivotally connected at one end to one end of the canopy, at least one member pivotally connected at one end to the other end of the shield section, and at the other end to the base section, and hydraulic prop means for raising and lowering the canopy relative to the base section, wherein the canopy is provided with an opening and a door is mounted with respect to the canopy for pivotable movement between a first position in which it closes or substantially closes the opening in the canopy and a second position in which it is inclined downwards away from said one end and towards the other end of the canopy for guiding material which in use falls through the opening towards a conveyor located adjacent to a mine face being worked.

2. A mine roof support as claimed in claim 1, wherein the door is in the form of a chute.

3. A mine roof support as claimed in claim 1, wherein the canopy is a rigid single part canopy having a stepped upper surface defining a first portion at and adjacent to said one end of the canopy and a second portion, which is elevated with respect to the first portion, at and adjacent to the said other end of the canopy, the opening being provided in the first portion of the canopy.

4. A mine roof support as claimed in claim 1, wherein the hydraulic prop means comprises first hydraulic prop means between the base section and the canopy and second hydraulic prop means between the base section and the door, the second hydraulic prop means serving to open and close the door and also to assist in supporting the canopy when the door is closed.

5. A mine roof support as claimed in claim 4, wherein hydraulic ram means is provided between the shield section and the canopy to stabilise the canopy and shield section when the door is open.

* * * * *